United States Patent [19]

Reuter

[11] Patent Number: 4,482,002

[45] Date of Patent: Nov. 13, 1984

[54] RACK-CHANGING APPARATUS FOR A CONTINUOUS CASTING INSTALLATION

[75] Inventor: Hans J. Reuter, Kürten-Biesfeld, Fed. Rep. of Germany

[73] Assignee: Mecan Arbed S.a.r.l., Luxembourg, Luxembourg

[21] Appl. No.: 505,897

[22] Filed: Jun. 21, 1983

Related U.S. Application Data

[63] Continuation of Ser. No. 207,078, Nov. 14, 1980, abandoned.

[30] Foreign Application Priority Data

Nov. 16, 1979 [LU] Luxembourg ..... 81905

[51] Int. Cl.[3] ..... B22D 11/128

[52] U.S. Cl. ..... 164/442; 164/448; 414/728

[58] Field of Search ..... 164/442, 441, 448, 447, 164/420, 483; 414/728

[56] References Cited

U.S. PATENT DOCUMENTS

| | | | |
|---|---|---|---|
| 3,178,040 | 4/1965 | Nelson | 414/728 |
| 3,763,923 | 10/1973 | Gallucci | 164/448 |
| 4,223,715 | 9/1980 | Streubel | 164/448 X |

FOREIGN PATENT DOCUMENTS

| | | | |
|---|---|---|---|
| 1285095 | 12/1968 | Fed. Rep. of Germany | 164/448 |
| 51-17940 | 6/1976 | Japan | 164/448 |
| 597944 | 4/1978 | Switzerland | 164/442 |
| 1414342 | 11/1975 | United Kingdom . | |
| 378050 | 7/1975 | U.S.S.R. | 164/448 |

*Primary Examiner*—Nicholas P. Godici
*Assistant Examiner*—J. Reed Batten, Jr.
*Attorney, Agent, or Firm*—Herbert Dubno; Karl F. Ross

[57] ABSTRACT

A rack-changing apparatus for a continuous casting installation, especially for changing the curved guide, support and cooling racks of a continuous casting installation having a plurality of casting lines, has a carriage which is shiftable transversely to the casting lines on rails mounting below the casting floor and preferably extending beyond the installation to a location at which the racks can be deposited and picked up. An arm on the carriage is swingable in a vertical plane about a horizontal axis and is extensible and retractable while carrying on its end a clamping mechanism swingable in a vertical plane about a horizontal axis at the arm end for engagement with the racks.

3 Claims, 1 Drawing Figure

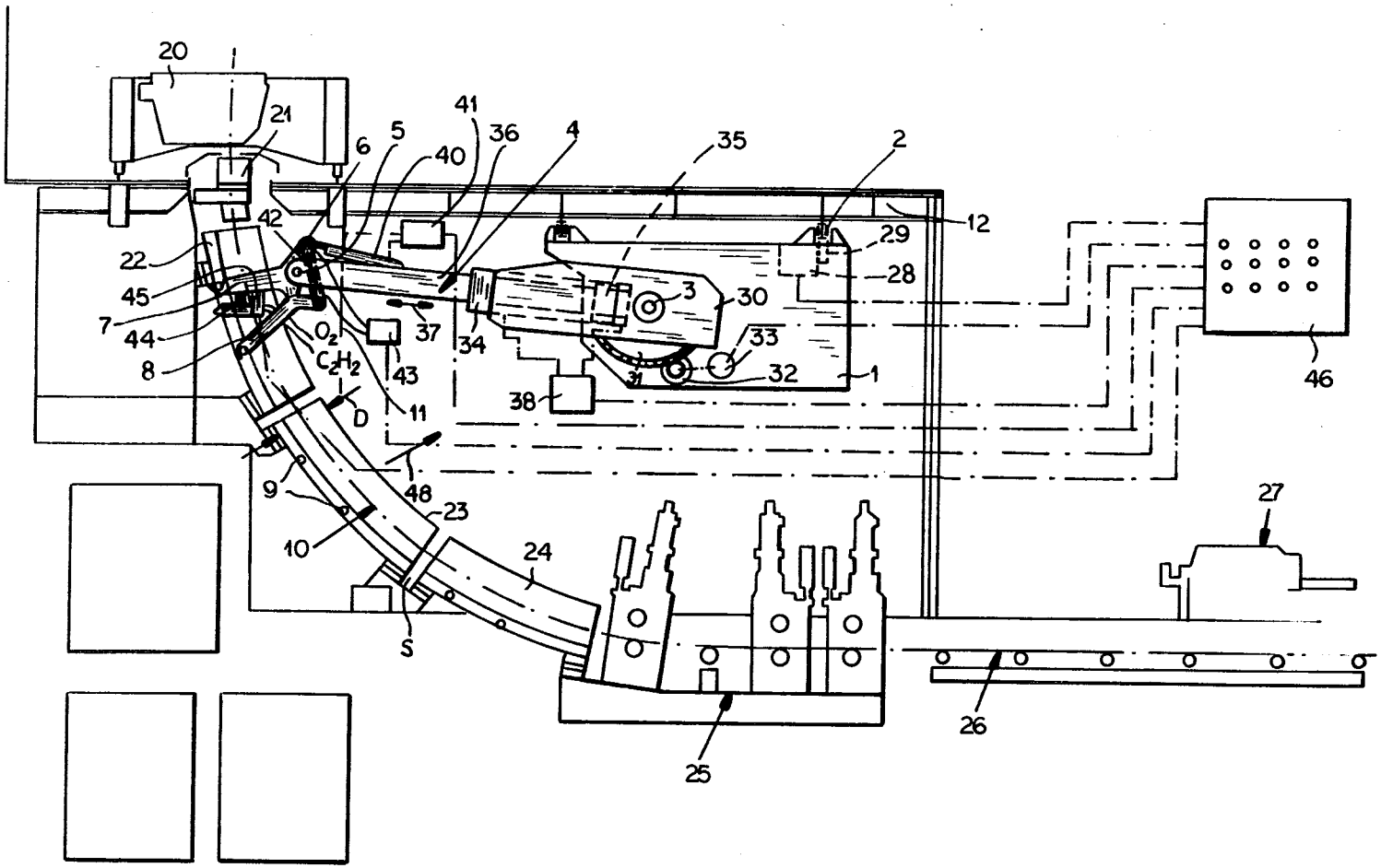
46
27
26
12
2
29
28
1
32
33
30
35
3
31
25
4
38
24
36
34
41
40
37
23
48
5
43
11
S
6
D
$C_2H_2$
$O_2$
10
21
42
9
20
22
45
44
8
7

RACK-CHANGING APPARATUS FOR A CONTINUOUS CASTING INSTALLATION

This application is a continuation of application Ser. No. 207,078 filed Nov. 14, 1980 and now abandoned.

FIELD OF THE INVENTION

My present invention relates to an apparatus for changing the guide, support and cooling racks of a continuous casting installation and, more particularly, to equipment enabling the removal of a curved rack from a continuous casting line for cleaning and replacement.

BACKGROUND OF THE INVENTION

In the continuous casting of steel slabs, ingots, billets or blooms, a tundish on a casting floor is aligned with an upright mold into which the molten metal is fed. Upon solidification of at least a peripheral portion of the ingot, the latter moves continuously from the mold and is generally guided in a curved path from its upright original orientation to a horizontal orientation at which the slab may meet a reheating furnace, a sizing mill, a cutoff device severing individual lengths from the continuous strand, etc.

Along this curved path the slab is supported and guided by rollers as it cools, the rollers being assembled in clusters or racks successively encountered by the strand. Such racks are generally termed support and guide racks and may be associated with water spray nozzles, lattices or networks.

It is common practice to provide so-called multibranch casting lines which comprise a plurality of molds in transversely spaced relationship which can be fed by a common ladle with molten steel, for example, through respective tundishes or through a single tundish provided with a number of outlets, or by a tundish which is movable selectively into alignment with each mold. Each mold is then associated with respective group of curved support and guide racks of the type described.

For a discussion of the principles involved in continuous casting and details of the elements described, reference is made to pages 708 ff. of *The Making, Shaping and Treating of Steel*, United States Steel, Co. Pittsburgh, PA, 1971.

When the rollers, spray manifolds, nozzles or other elements of these racks become soiled or contaminated, in the event of a breakdown in the continuous casting operation, and when a change in the nature or shape of the casting to be produced is to be effected, it is desirable to remove these racks and replace them with other racks in as rapid and efficient a manner as is possible to minimize the downtime of the unit.

It is conventional to make these racks so that they can be moved as a unit with remnants of a casting therein and/or of the open-door type so that they can be withdrawn from position leaving the casting remnant in place, or to make them movable so that replacement of the racks is facilitated.

In general, the ingot mold is first removed by the portal or roof crane of the steel-making plant, albeit with considerable difficulty because of the tightness of space and the fact that continuous casting lines are usually close to one another and associated with auxiliary equipment such that access to the mold is difficult. Thereafter, the racks below the mold are removed by special cranes mounted below the casting floor. The casting floor is the level in the plant at which the tundish is located and below which the curved racks are arranged.

In the removal of supporting guide racks of the aforedescribed type in conventional installations, moreover, the racks must be drawn through special openings provided in the casting floor in a time-consuming dismounting process which interrupts the output of the plant for considerable periods.

To eliminate these extensive downtimes, special carriages have been proposed enabling insertion and withdrawal of the racks and which can be displaced in the opposite direction from the casting direction.

However, in some continuous casting installations and especially in multibranch casting installations, the tundish can be mounted on a turntable which has a support or foundation behind the array of curved racks and thus prevents the use of this system for installing and removing the racks. Earlier systems which attempted to withdraw the racks from one side or the other have been ineffective because the presence of adjacent racks in multibranch casting lines has limited the possibility of movement in these directions. Increasing the spacing between the casting lines might enable such lateral techniques to be used effectively at the cost of much space in the mill.

Finally, mention must be made of efforts to extract and insert the racks in the direction of movement of the casting. In practice these systems have been found to be applicable only to single-line and double-line continuous casting installations. Otherwise, the additional lines interfered with the carriages which have been proposed for this purpose.

OBJECTS OF THE INVENTION

It is the principal object of the present invention to provide an improved apparatus of the character described which obviates the disadvantages of earlier systems for the removal and replacement of the guide and support racks of a continuous casting installation.

Another object of the invention is to provide an apparatus for rapidly removing and replacing the curved support and guide racks of a continuous casting installation which is effective for all of the racks of a given line and all of the racks of all of the lines whether two or more lines are provided.

Still another object of the invention is to provide an improved rapidly-acting, simple, reliable and safe rack-changing apparatus which is not impeded in its operation by the presence of more than one continuous casting line.

SUMMARY OF THE INVENTION

These objects and others which will become apparent hereinafter are attained, in accordance with the present invention by providing a carriage which is transversely shiftable on rails mounted above the horizontal stretches of the casting lines assuming that the apparatus is to be utilized for a multibranch continuous casting installation, so that the carriage can be positioned with an outrigger arm coplanar with the casting line from which racks are to be removed or replaced.

According to the invention this arm is extensible and retractable relative to the carriage and is swingable about a horizontal pivot axis on the carriage to allow the free end of the arm to be positioned adjacent each of the racks to be removed in turn. The free end of the arm is provided with a support and clamping mechanism engageable with each guide or support rack and swingable relative to the end of the arm in the aforementioned horizontal plane about a second horizontal axis. Upon engagement of this mechanism with each rack, the latter can be drawn generally radially relative to the curvature of the set of racks, away from its original position and then carried by an appropriate displacement of the carriage to a location laterally offset from the casting installation and at which the rack can be deposited or another rack can be picked up.

The arm which is retractable and extensible thus is displaced generally parallel to the direction of movement of the casting. It has been found to be advantageous, moreover, to provide the carriage with its own drive so that this carriage can be displaced across all of the casting lines transverse to the direction of movement of the castings and at least limitedly beyond the collection of casting lines to the station at which the rack is deposited or another rack is picked up.

The drive for linear movement of the arm (retraction and extension) is constructed and arranged so that the free end of the arm can be displaced through a distance equal at least to the depth of the guide or support rack to be removed or installed, thereby ensuring that each removed rack can clear racks of other lines in the same position during travel of the carriage across the collection of lines.

The mechanism and drive for pivotally displacing the arm is so constructed and arranged that the arc through which the free end can swing, i.e. the degree or angular displacement, is at least equal to the arc length of the set of arcuate racks between the upright mold and the horizontal stretch of the casting line. The mold thus need not be removed for removal or replacement of the racks which form segments of the arcuate path of the casting. Each of the racks can thus be removed and replaced individually by a single apparatus in accordance with the invention in a trouble-free manner.

According to a feature of the invention, the support and clamping mechanism can comprise a support arm which engages beneath a projection or formation on each rack, and a clamping arm engageable with another formation so as to hold the rack in a position enabling the support arm to take up the weight of the rack and prevent swinging of the rack on the support arm. The support arm and the clamping arm can each be constructed to straddle the rack and engage such formations on opposite sides thereof. The actuator for pivotally displacing this mechanism on the free end of the arm about the second horizontal axis should be dimensioned to allow pivoting through at least 90° about this axis.

It has been found to be sufficient to enable each rack to be engaged at two points and the angular displacement of the mechanism allows such engagement independently of the orientation of the rack.

The various drives mentioned above can be controlled from a remote location using servocontrolled valves or servomechanisms of conventional design and it has also been found to be advantageous to provide the support and clamping mechanism with a burner for cutting off a length of the cast strand so the replacement of a rack need not await the passage of the end of the casting through the system.

BRIEF DESCRIPTION OF THE DRAWING

The above and other objects, features and advantages of the present invention will become more readily apparent from the following description, reference being made to the accompanying drawing in which the sole FIGURE is a highly diagrammatic vertical elevational view of one continuous casting line of a multibranch continuous casting installation provided with the apparatus of the present invention.

SPECIFIC DESCRIPTION

The continuous casting installation shown in the drawing comprises in the usual manner a tundish 20 which can be mounted on a turntable or carriage for selective communication with each mold 21 of each continuous casting line, only one of which has been shown in the drawing.

In the usual manner, the tundish is mounted on the casting floor 12 and the mold discharges through this floor a continuous casting into the upper guide and support rack 22 which can be provided with the usual guide rolls and water spray lattice to cool the continuous casting. The latter then passes into another guide or support rack 23 and then to a final guide or support rack 24, both of which have arrays of rollers before passing into the slab straddler 25 and onto the horizontal stretch 26 of the casting line to further processing apparatus represented at 27 and including, for example, a reheating furnace, a sizing mill and a traveling-torch cut-off unit.

The assembly of segmental racks 22–24 has been represented at 10.

According to the invention, the racks may be removed and replaced by an apparatus which comprises a carriage 1 suspended from a pair of rails 2 mounted on the underside of the casting floor 12 and driven therealong by a motor 28 and a pinion 29 which can mesh with rack teeth on the underside of one of the rails 2.

The carriage is thus displaceable above the horizontal stretches of the various casting lines transversely of the planes thereof and across the entire set of casting lines and advantageously therebeyond at which a station (not shown) is provided for the deposition and pickup of guide and support racks removed from the set 10 or adapted to form the set 10.

The carriage 1 defines a horizontal axis 3 which can be located approximately at the centers of curvature of the rack sets 10, arm 4 received in a housing 30 being pivotally mounted to swing about the axis 3. To this end, the housing 30 is formed with a gear 31 meshing with a pinion 32 and driven by a motor 33.

The housing 33 carries the arm 4 which comprises an outer member 34 forming a hydraulic cylinder for a piston 35 at one end of a member 36 which can be extended from or drawn into the cylinder in the direction of arrow 37 by hydraulic fluid supplied to the compartments on opposite sides of the piston 35 by a control valve arrangement represented diagrammatically at 38 and, for example, operable from a remote location. The piston 35 forms "second drive means" on the carriage 1.

The free end of arm 4 defines an axis 5 which, like the axis 3, is horizontal and transverse to the direction of movement of the casting.

A support and clamping mechanism 6 is pivotally mounted about this axis on the free end of the arm so as to be able to swing through 90°, this mechanism comprising a support arm 7 which engages beneath a laterally projecting pin 9, and a locking arm 8 which engages the other projection of the rack and is shown to be fulcrummed on the arm 7. The arm 7 is displaced by a cylinder 40, shown to be on the carriage 1 and forming a "fourth drive means", as determined by the actuation of a control 41. The locking bar 8 is operated by a cylinder 42 whose controller is shown at 43 and which is also shown to be on the carriage 1 as a "fifth drive means".

The support arm 7 also carries a burner 44 supplied with oxygen and acetylene, for example, and adapted to be juxtaposed with the continuous casting and positioned by the arms 4 and 7. Upon movement of the carriage 1 along the rails 2 a particularly clean cut can be produced across the width of the casting so that a rack can be rapidly cut loose without waiting for the cast end to pass by. The burner control is represented at 45.

The positioning of the arms and the operating sequence are controlled, e.g. by a keyboard signal transmitter 46 at a remote location using conventional servomechanism technology.

The operating sequence provided by the controller 46 requires first that the carriage be moved so that its arm 4 is coplanar with the casting line in which a support or guide rack is to be replaced and/or from which a rack is to be removed. The motor 33 then positions the free end of the arm 4 in juxtaposition with one of the racks, the support arm 7 and the locking arm 8 are engaged with the rack and the arm 4 is retracted to withdraw the rack in the direction of arrow 48.

The retraction of arm 4 shifts the rack by an amount greater than the depth dimension D of the rack so that further movement of the carriage 1 can enable the rack to clear any projections or edges of adjoining racks.

If the rack is not free from a casting strand, the burner is juxtaposed with a slot S, for example, between two racks and the burner is brought into play to sever the continuous casting strand and enable movement of the carriage 1 with the rack transversely to the direction of movement of the casting. The rack can also clear the cooling chamber walls shown at 11.

While the racks of one casting line are being changed, an adjacent rack can remain operative to ensure a continuous output. The invention increases the productivity of the apparatus and affords the possibility of complete automation so that danger to operating personnel is excluded.

I claim:

1. In a continuous casting installation having a casting floor, at least one tundish on said casting floor, and at least one casting line receiving molten metal from said tundish and forming a continuous casting therefrom, said casting line comprising a mold positioned below said tundish and a plurality of guide and support racks in the form of arc segments disposed below said casting floor and receiving said casting for transferring said casting from said mold to a horizontal stretch, the improvement which comprises an apparatus for removing said racks from and replacing such racks in said line, said apparatus comprising:

a track below said casting floor and above said stretch and transverse thereto;

a carriage mounted on said track for displacement transversely to said stretch below said floor and above said stretch;

an extensible and retractable outrigger arm swingably mounted on said carriage for movement in a vertical plane about a horizontal axis on said carriage, said outrigger arm having a free end adapted to be selectively juxtaposed with said racks;

a support and clamping mechanism pivotally mounted on said free end of said outrigger arm about a further horizontal axis and engageable with a rack upon juxtaposition of said free end therewith whereby the engaged rack can be withdrawn from said line and moved transversely to said line upon displacement of said carriage, said mechanism including a support arm engageable under a pin projecting laterally from a rack and a clamping arm adapted to brace downwardly against another pin projecting laterally from the same rack and below the first mentioned pin, said support and clamping arms being relatively swingable;

first drive means operatively connected with said carriage for independently displacing same along said track;

second drive means on said carriage connected with said outrigger arm for extending and retracting same relative to said carriage by a distance equal at least to the width of said racks;

third drive means on said carriage engaging said outrigger arm for angularly displacing the outrigger arm about the horizontal axis through at least the arc length of all the segments of said line;

fourth drive means on said carriage operatively disposed between said mechanism and said outrigger arm for angularly displacing said mechanism about the further horizontal axis through at least 90°; and fifth drive means on said carriage for clamping said mechanism onto a rack to be engaged thereby by actuating said clamping arm to relatively swing said support and clamping arms.

2. The improvement defined in claim 1, further comprising a remote operating station connected to and controlling all of said drive means.

3. The improvement defined in claim 1 or claim 8 wherein said mechanism is provided with a burner for cutting said casting upon movement of said carriage along said track.

* * * * *